US005772479A

United States Patent [19]

Fleege et al.

[11] Patent Number: 5,772,479

[45] Date of Patent: Jun. 30, 1998

[54] CIRCUIT BREAKER WITH TERMINAL NUT RETAINER

[76] Inventors: Dennis William Fleege, 20 26th St. SW., Cedar Rapids, Iowa 52404; Donald Charles Francis, Jr., 2941-18 Sixth St. SW., Cedar Rapids, Iowa 52404; Randall Luther Siebels, 4219 Dalewood Ave. SE., Cedar Rapids, Iowa 52403

[21] Appl. No.: 644,508

[22] Filed: May 10, 1996

[51] Int. Cl.[6] ..... H01R 4/30

[52] U.S. Cl. ..... 439/801; 335/202

[58] Field of Search ..... 439/801; 335/202; 361/634, 637, 652

[56] References Cited

U.S. PATENT DOCUMENTS

| | | | |
|---|---|---|---|
| 4,070,086 | 1/1978 | Trafford | 439/717 |
| 4,171,862 | 10/1979 | Krasser | 439/717 |
| 4,794,356 | 12/1988 | Yu et al. | 335/13 |
| 4,796,844 | 1/1989 | Barker | 248/222.2 |
| 4,809,132 | 2/1989 | Palmieri et al. | 335/202 |
| 4,831,221 | 5/1989 | Yu et al. | 200/553 |
| 4,864,263 | 9/1989 | Castonguay et al. | 335/167 |
| 4,912,439 | 3/1990 | Nagy et al. | 335/132 |
| 5,172,088 | 12/1992 | Morgan | 335/201 |
| 5,252,937 | 10/1993 | Bernier et al. | 335/202 |
| 5,272,591 | 12/1993 | Blue et al. | 361/622 |
| 5,272,592 | 12/1993 | Harris et al. | 361/637 |
| 5,404,266 | 4/1995 | Orchard et al. | 361/667 |
| 5,418,683 | 5/1995 | Orchard et al. | 361/672 |
| 5,430,419 | 7/1995 | Scheel et al. | 335/16 |

FOREIGN PATENT DOCUMENTS

| | | | |
|---|---|---|---|
| 288406 | 10/1988 | European Pat. Off. | 439/801 |
| 141885 | 5/1980 | Germany | 439/801 |

*Primary Examiner*—Neil Abrams
*Attorney, Agent, or Firm*—Larry I. Golden; Kareem M. Irfan

[57] ABSTRACT

The present invention provides a circuit breaker having a terminal nut retainer 10 for securely holding a nut 65 in a fixed position adjacent and below a circuit breaker terminal 60. The circuit breaker is placed in a circuit by securing a source electrical connector to a source terminal and/or a load electrical connector to a load terminal. A screw 61 is used to fasten the electrical connector 67 to its respective terminal 60. The nut 65 for the screw 61 is held in a fixed position by the terminal nut retainer 10. The terminal nut retainer 10 has a nut retaining cavity 14 defined by walls which hold the nut 65 and keep it from turning while the screw 61 is tightened to establish a tight electrical connection between the connector 67 and the terminal 60. The terminal nut retainer 10 is held in position by a sliding and locking engagement between projections 30 and 34, respectively, on the terminal nut retainer 10 and slots 52 and 54, respectively, in the circuit breaker casing.

16 Claims, 9 Drawing Sheets

CIRCUIT BREAKER WITH TERMINAL NUT RETAINER

BACKGROUND OF THE INVENTION

1. Field of the Invention

This invention relates generally to electric circuit breakers and more particularly to terminal connections.

2. Description of the Related Art

Electrical circuit breakers are commonly used for temporary interruption of electrical power to electrical devices or loads. Various circuit breaker mechanisms have evolved and have been perfected over time on the basis of application-specific factors such as current capacity, response time, and the type of reset (manual or remote) function desired of the circuit breaker.

One type of circuit breaker mechanism employs a thermo-magnetic tripping device to trip a latch in response to a specific range of over-current conditions. In another type of circuit breaker, referred to as a double-break circuit breaker, two sets of current breaking contacts are included to accommodate a higher level of over-current conditions than can be handled by one set of contacts. The electro-mechanical assembly that is typical of those used in circuit breakers of the present invention has been described before. For this reason U.S. Pat. No. 5,430,419 is incorporated herein by reference in its entirety.

A circuit breaker typically has two terminals, one for connection to a power source and one for connection to the load. Connection of these terminals places the circuit breaker within the circuit between the source and the load. These connections may be assembled in a factory or in the field. In either case it is preferable to simplify the assembly. The terminal connecting to a source is typically connected to a bus bar, while the terminal connecting to the load may be connected to a crimp lug or some other type of connector.

A circuit breaker terminal can be connected to its source or load by various means including bolts, screws, and friction fits or snap-ons. Generally, a rod-shaped connector, such as a bolt or screw, is inserted through an eyelet or similar opening in a terminal and through an opening in a connector for the source or load. A receiving or tightening device, such as a nut, is attached to the rod-shaped connector for making up and tightening the connection between the terminal and the source or load.

Where a screw is used to make the connection, holding a nut for assembly of the connector to the terminal is difficult. Further, there must be a sufficient distance between the nut and a grounded surface to prevent an arc from the nut, when energized, to the grounded surface. A plastic insulating sheet has been used in the past to provide a dielectric between energized parts and a grounded panel. The plastic sheet allows compact construction of a circuit breaker and panelboard assembly. However, a device that holds the nut in place for later assembly of the terminal to a connector would be desirable. It would also be desirable for the device to provide insulation between the screw and/or nut and the grounded surface.

SUMMARY OF THE INVENTION

The present invention provides a circuit breaker for interrupting power in a circuit path between a source and a load. The circuit breaker has an electro-mechanical assembly including first and second contacts cooperatively arranged in the circuit path for providing current from the source to the load. At least one of the contacts is movable for interrupting the power provided to the load, and a terminal is connected to the first contact. A casing encloses the electro-mechanical assembly, and a terminal nut retainer engages the casing proximate to the terminal for holding a nut.

Preferably, the terminal nut retainer is a molded dielectric having a box-shaped body, and the body has a top, a bottom, and first opposing sides therebetween. In one embodiment, the first opposing sides have a tenon and a mortise adjacent the tenon for sliding engagement with the casing and a projection for locking engagement with the casing. The body preferably has a cavity for receiving the nut. The cavity is defined by walls, which hold the nut, and is open to the top.

In another aspect the invention provides an article of manufacture for holding a nut for engagement with a screw. The article of manufacture comprises a body which has a cavity defined by walls. The walls hold the nut in a fixed position so that a screw can be engaged with the nut. The body has a tenon and a mortise adjacent the tenon. In a preferred embodiment, the body also has a projection.

In another aspect the invention provides a method for holding a nut close to a terminal. The method comprises: (a) placing the terminal in a casing having opposing grooves below the terminal, (b) molding a terminal nut retainer comprising a body having a cavity, for holding the nut, and opposing sides, wherein the sides have projections for engaging the grooves, (c) placing a nut in the cavity, and (d) inserting the terminal nut retainer into the casing, wherein the projections engage the grooves. Preferably, the body has a first tenon and a first mortise adjacent the first tenon, and the casing has a second mortise and a second tenon for sliding engagement with the first tenon and the first mortise, respectively.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
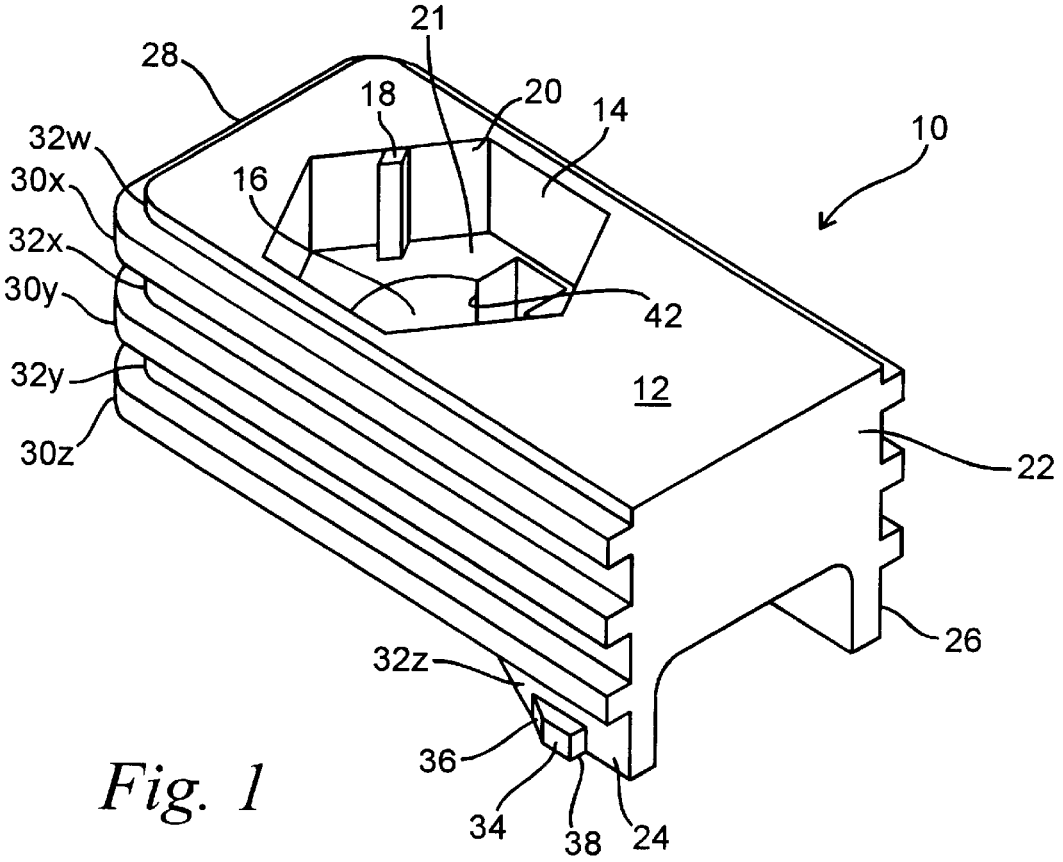
FIG. 1 shows a perspective view of a terminal nut retainer according to the present invention.

With reference to the drawings where like elements are labeled with like numbers, FIG. 1 shows an perspective view of a terminal nut retainer 10. The terminal nut retainer 10 is preferably made using a mold and a nonconductive material, a dielectric, which is typically, but not necessarily, a thermoplastic material. The material is preferably resilient and slightly flexible. The terminal nut retainer 10 has a top surface 12 in which there is a nut retaining cavity 14. Below the nut retaining cavity 14 is a screw receiving opening 16. A ridge 18 projects into the nut retaining cavity 14. Walls 20 and floor 21 define the nut retaining cavity 14 which is open toward the top surface 12. The ridge 18 provides a friction fit for a nut (not shown) which may be placed in the nut retaining cavity 14. The walls 20 and floor 21 hold the nut and prevent the nut from turning and/or from being pushed away as a screw is engaged with the nut.

The terminal nut retainer 10 has a front panel 22, a left side panel 24, a right side panel 26, and a rear panel 28. Projections 30*x*, 30*y*, and 30*z* (referred to collectively as projections 30) extend from the left side panel 24, the right side panel 26, and the rear panel 28. Slots 32*w*, 32*x*, 32*y*, and 32*z* (referred to collectively as slots 32) are formed adjacent the projections 30. The projections 30 are tenons, and the slots 32 are mortises. As described below, these tenons and mortises engage mating mortises and tenons in sliding engagement.

Figure 2:
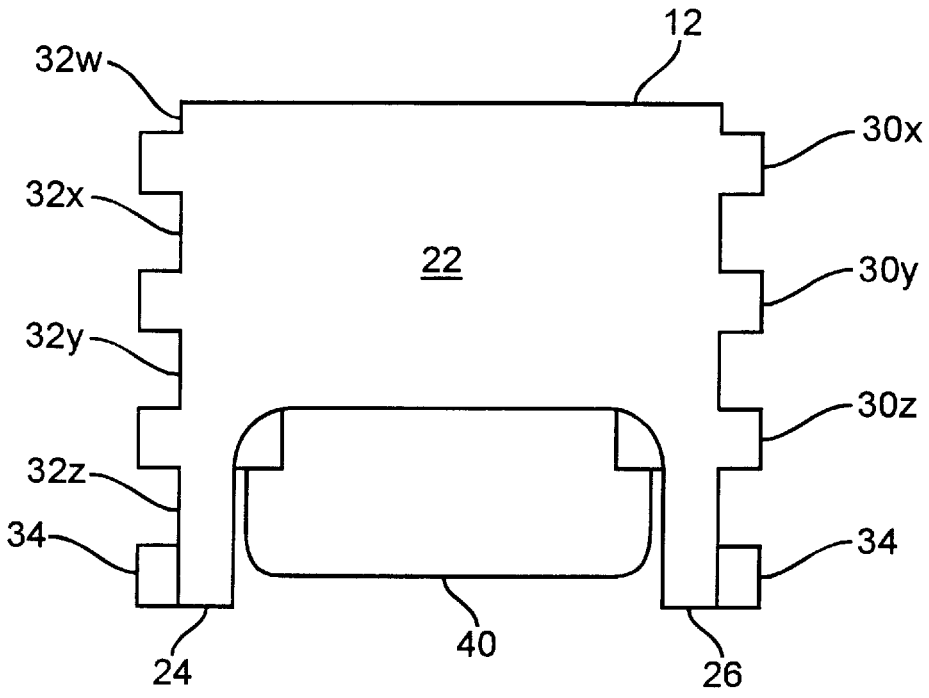
FIG. 2 shows a front elevation of the terminal nut retainer of FIG. 1.
Figure 3:
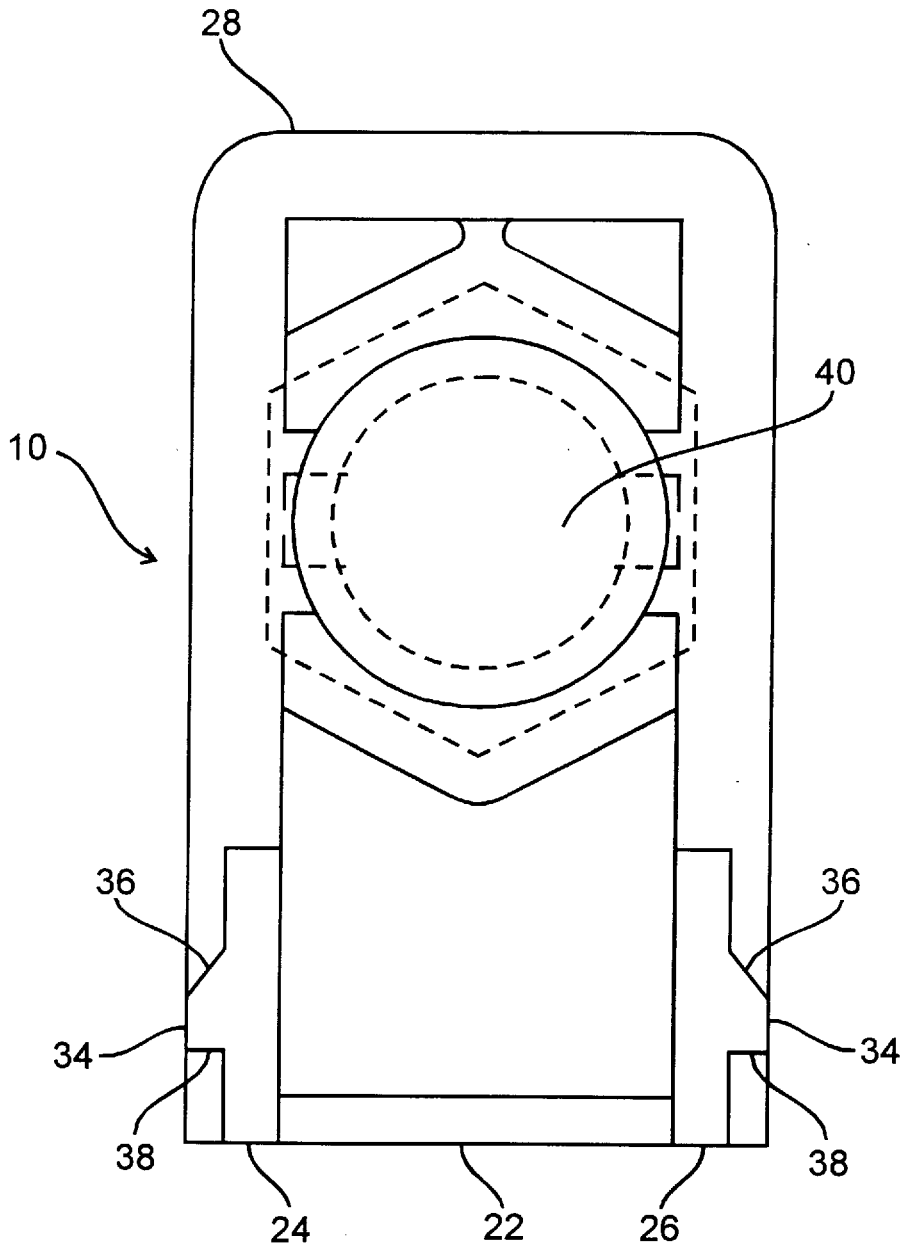
FIG. 3 shows a bottom view of the terminal nut retainer of FIG. 1.

With continuing reference to FIG. 1 and with reference now to FIG. 2, which is a front elevation of the terminal nut retainer 10, locking projections 34 are provided on the left side panel 24 and the right side panel 26. As described below, the locking projections 34 hold the terminal nut retainer 10 securely in place. FIG. 3 shows a bottom view of the terminal nut retainer 10. As best seen in FIGS. 1 and 3, the locking projections 34 have a ramp 36, which allows the locking projections 34 to slide into position. To prevent the terminal nut retainer 10 from sliding back out of position, the locking projections 34 have shoulders 38, which hold the terminal nut retainer 10 in a locked position. If desired, shoulders 38 may be angled or inclined toward the front panel 22 to make the terminal nut retainer 10 removable.

FIG. 3 illustrates that the screw receiving opening 16 has a bottom enclosure 40. Thus, the screw receiving opening 16 is open toward the top surface 12, but otherwise enclosed by the bottom enclosure 40. The bottom enclosure 40 is significant because the enclosure 40 provides insulation. The bottom enclosure 40, as well as the entire terminal nut retainer 10, is a dielectric. An energized screw (not shown) can be in the screw receiving opening 16, and yet, the screw is insulated, preventing an arc to a grounded surface.

Figure 4:
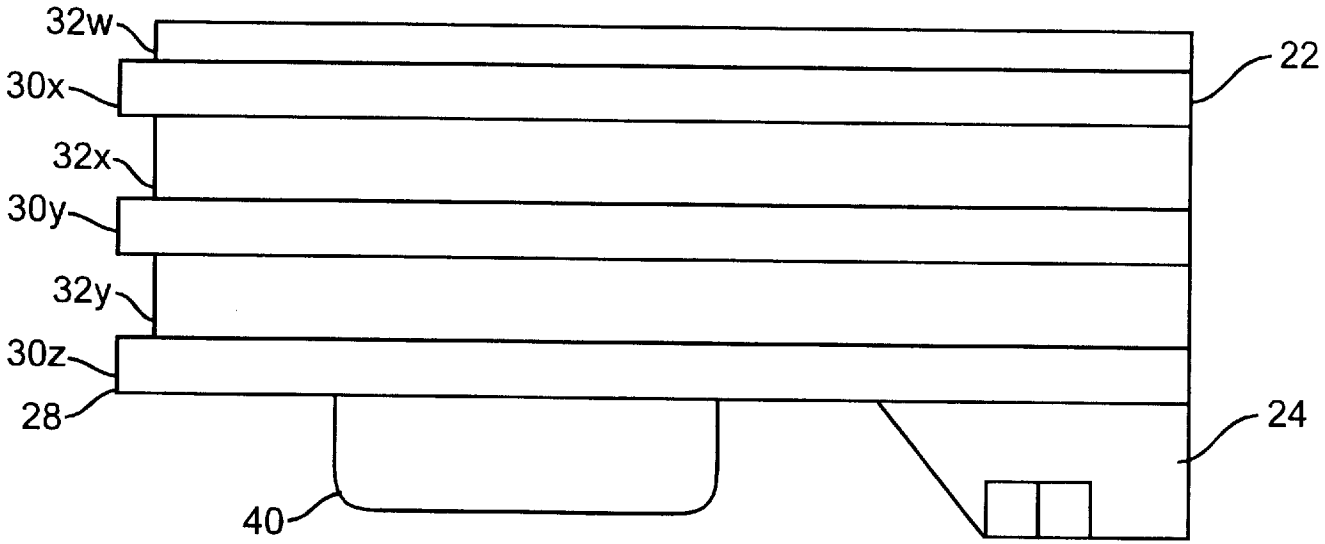
FIG. 4 shows a left side elevation of the terminal nut retainer of FIG. 1.
Figure 5:
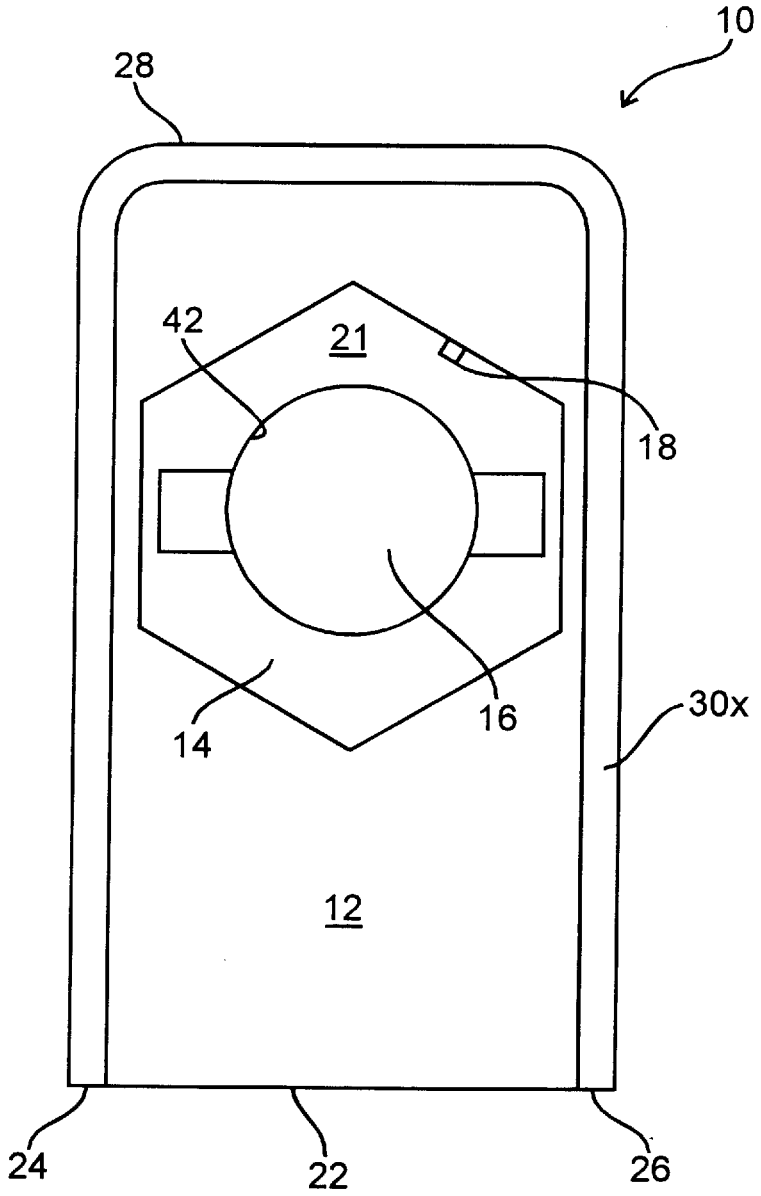
FIG. 5 shows a top view of the terminal nut retainer of FIG. 1.

FIG. 4 shows a left side elevation of the terminal nut retainer 10. The bottom enclosure 40 fully encloses a lower portion of the screw receiving opening 16. As best seen in FIG. 1, the nut retaining cavity 14 extends to a depth approximately where the projection 30*y* is located, and the floor 21 provides a transition into the screw receiving opening 16. FIG. 5 is a top view of the terminal nut retainer 10. The screw receiving opening 16 is defined by inside walls 42 of the bottom enclosure 40.

Figure 6:
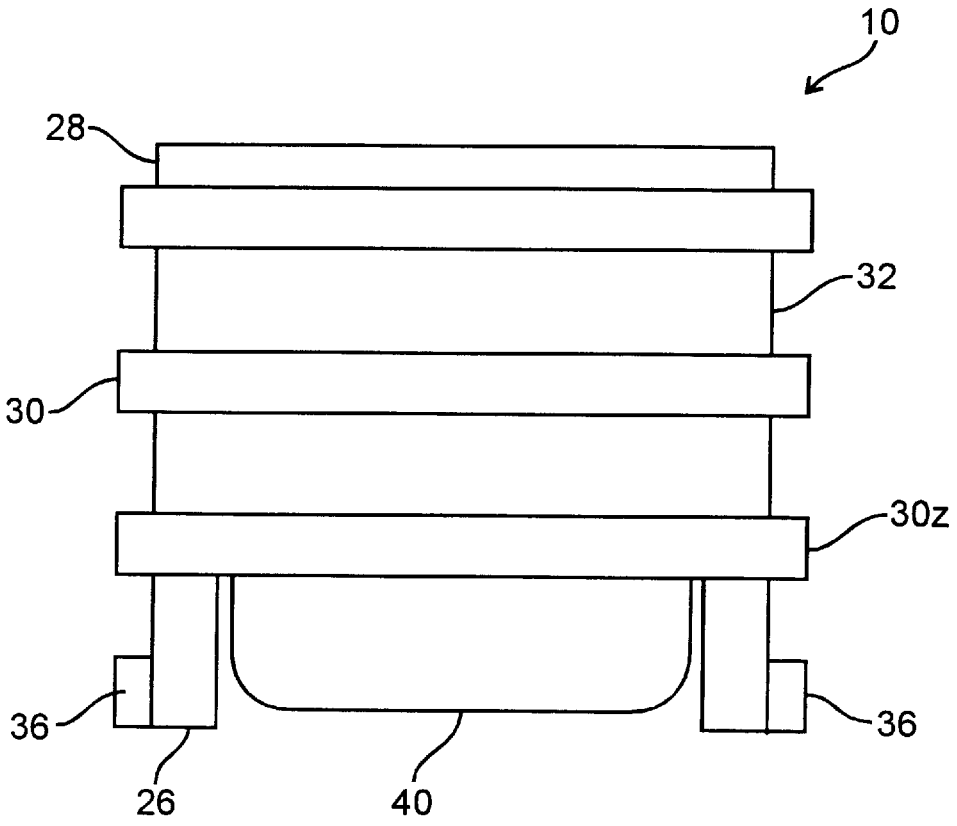
FIG. 6 shows a rear elevation of the terminal nut retainer of FIG. 1.

FIG. 6 shows a rear elevation of the terminal nut retainer 10. Comparing the rear elevation in FIG. 6 with the front elevation in FIG. 2, the front panel 22 does not extend as low as the rear panel 28. The rear panel 28 extends as low as the bottom edge of the projection 30*z*. The front panel 22 extends as low as slightly above the top edge of the projection 30*z*. The front panel 22 provides a strengthening member between the left side panel 24 and the right side panel 26. However, the front panel 22 does not extend any lower so that the left side panel 24 and the right side panel 26 can be squeezed together to allow insertion of the terminal nut retainer 10 into a receptacle.

Figure 7:
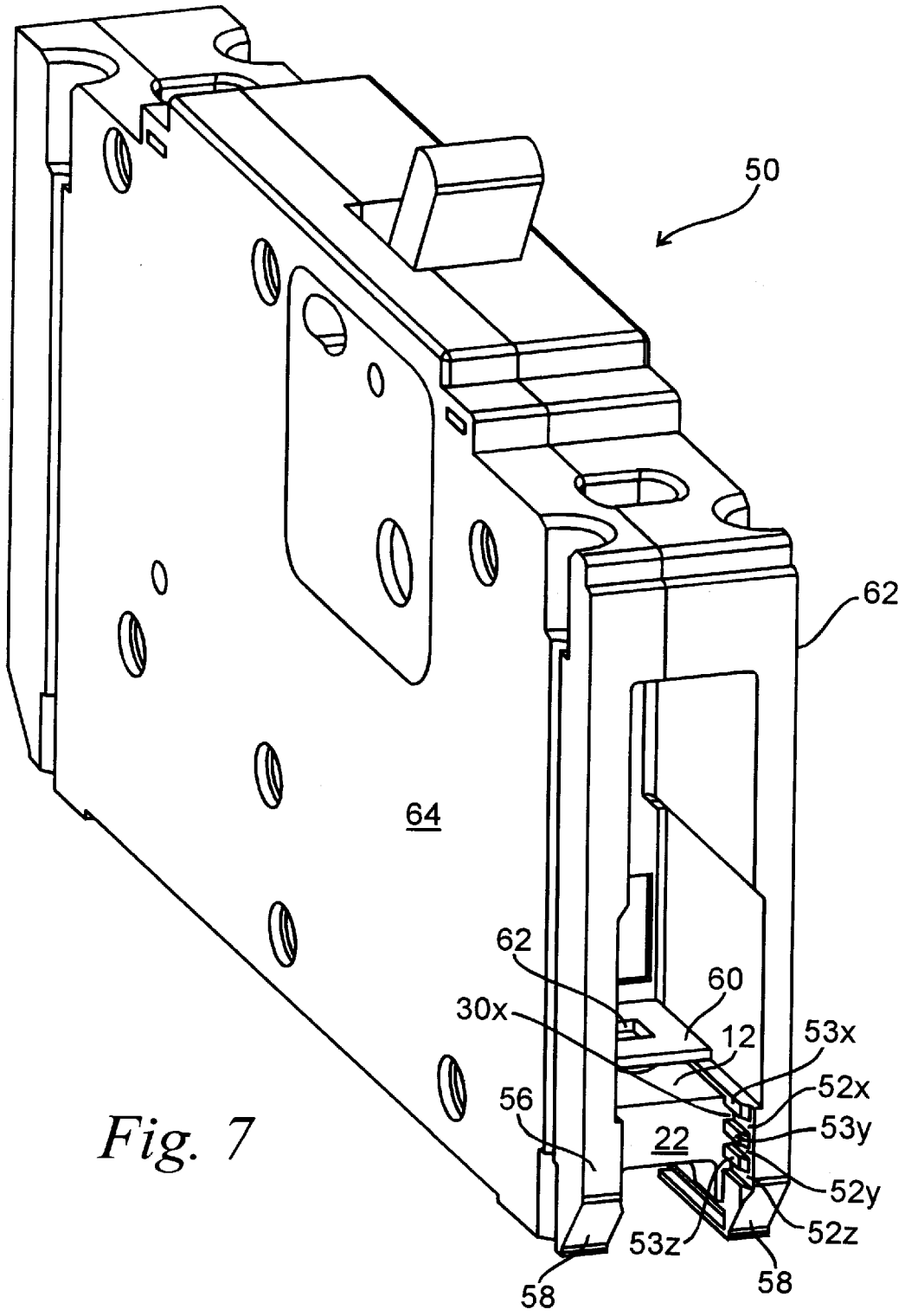
FIG. 7 shows a perspective view of a circuit breaker according to the present invention.
Figure 8:
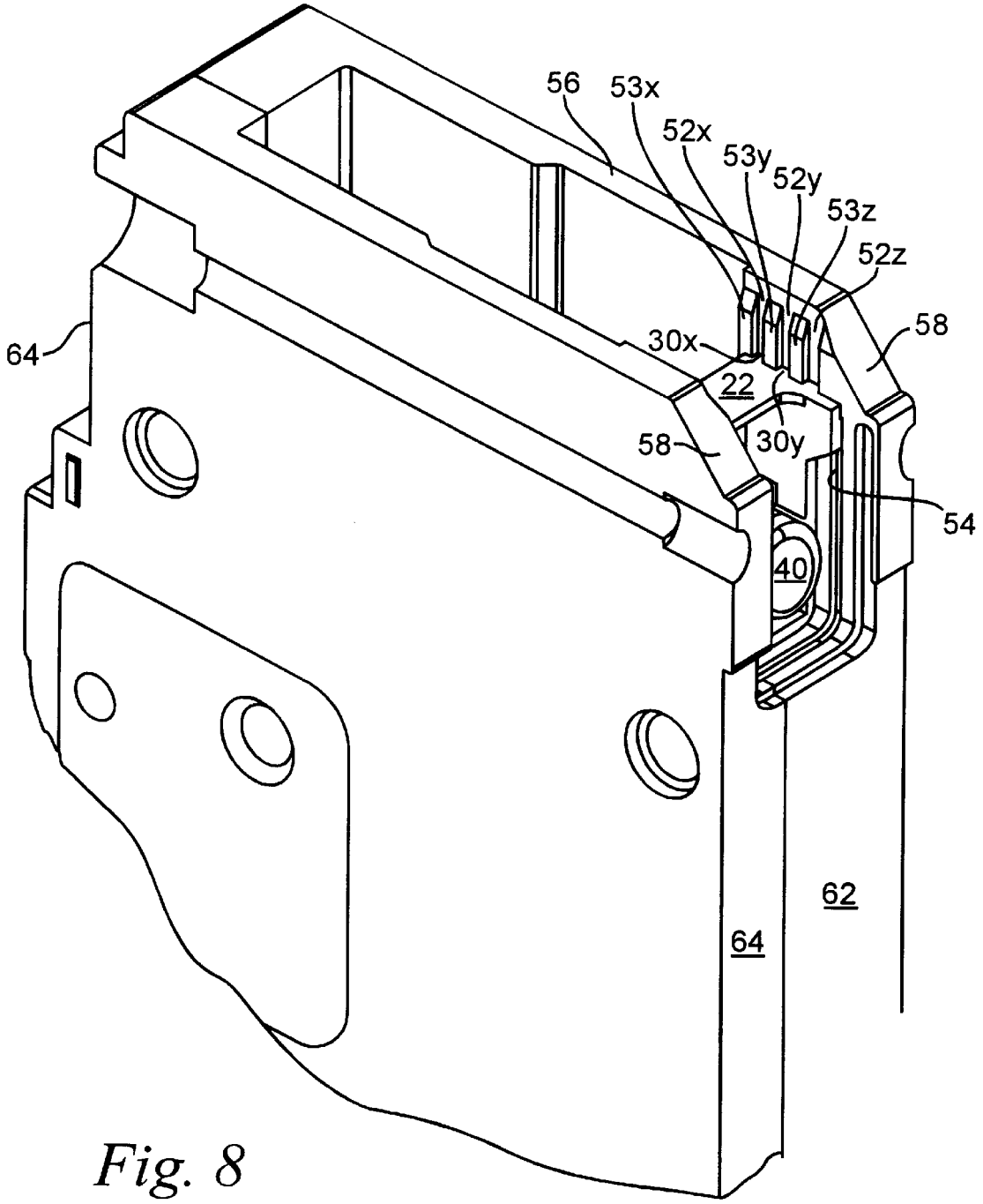
FIG. 8 shows a partial bottom perspective view of the circuit breaker of FIG. 7.

Referring now to FIG. 7, the terminal nut retainer 10 is shown inserted into its receptacle, and together they comprise a circuit breaker 50. A portion of the circuit breaker 50 of FIG. 7 is shown in FIG. 8, but in a bottom perspective view. The circuit breaker 50 has mortises or dielectric grooves 52*x*, 52*y*, and 52*z* (referred to collectively as grooves 52) for receiving the projections 30*x*, 30*y*, and 30*z*, respectively. The circuit breaker 50 has tenons or protrusions 53*x*, 53*y*, and 53*z* (referred to collectively as protrusions 53). The grooves 52 serve as mortises for the projections 30, which serve as tenons, but for a sliding engagement rather than a fixed joint. Likewise, the protrusions 53 serve as tenons and the slots 32 as mortises. The slots 32 and the grooves 52 provide channels for receiving the projections 30 and the protrusions 53. The projections 30 and the protrusions 53 slide in the grooves 52 and the slots 32, respectively.

As best seen in FIG. 8, the circuit breaker 50 also has an engaging slot 54 for receiving and engaging the locking projections 34. The grooves 52*x*, 52*y*, and 52*z* are open at their ends adjacent the end 56 of the circuit breaker 50. However, the engaging slot 54 is not open at its two ends adjacent the corner 58 of the circuit breaker 50.

The grooves 52*x*, 52*y*, and 52*z* receive and guide the projections 30*x*, 30*y*, and 30*z*, respectively. Pushing the projections 30 into engagement with the grooves 52, the ramps 36 of the locking projections 34 encounter the corners 58 of the circuit breaker 50. By pushing with some force on the front panel 22, the locking projections 34 are squeezed together enough for the ramps 36 to slide into the engaging slot 54. The ramps 36 are shaped like ramps to provide a gradual incline, allowing the left side panel 24 and the right side panel 26 to be pushed toward each other as the terminal nut retainer 10 is pushed into the grooves 52 and the engaging slot 54.

When the terminal nut retainer 10 is fully inserted, the locking projections 34 snap into the depth of the engaging slot 54. The shoulders 38 are squared off to prevent the terminal nut retainer 10 from backing out. The combination of the ramps 36 and the shoulders 38 provide for one-way insertion of the, terminal nut retainer 10. The terminal nut retainer 10 cannot be easily removed because the squared-off shoulders 38 engage the engaging slot 54. The front panel 22 allows the left side panel 24 and the right side panel 26 sufficient movement for insertion, but the front panel 22 serves as a strengthening member to prevent the terminal nut retainer 10 from backing out of its inserted position. Thus, the terminal nut retainer 10 is retained in a fixed position.

Figure 9:
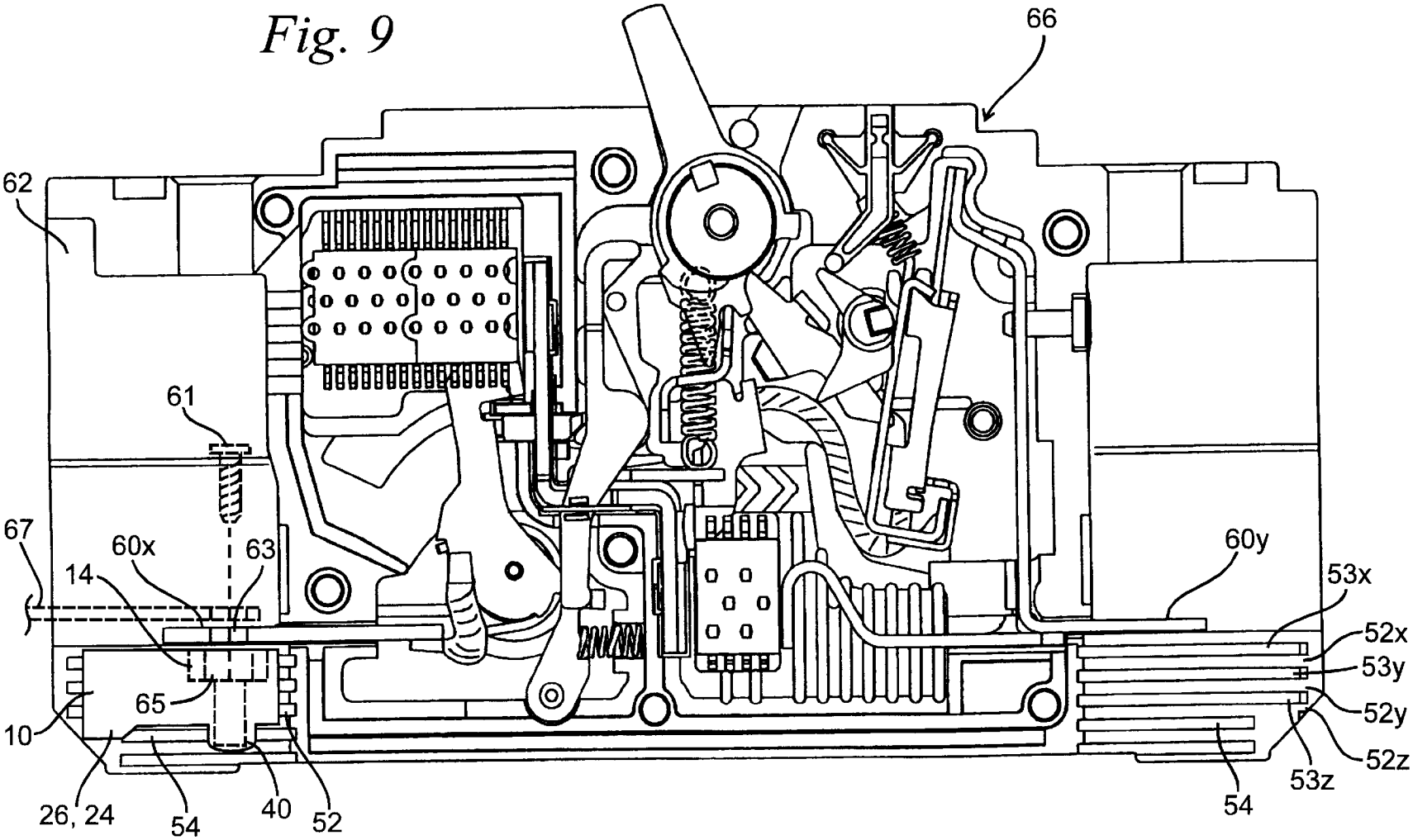
FIG. 9 shows a plan view of a circuit breaker electro-mechanical assembly and base according to the present invention.

FIG. 9 shows the base 62 without the cover 64. The grooves 52 and the engaging slot 54 are located below terminals 60*x* and 60*y* (referred to collectively as terminal 60). This location positions the terminal nut retainer 10 below the terminal 60. The terminal 60 has a hole 63 for receiving a screw. The nut retaining cavity 14 is located immediately below the hole 63 in the terminal 60. The grooves 52 and the engaging slot 54 are molded into the base 62 and a cover 64, which together provide a housing or casing for the circuit breaker 50.

With reference to FIG. 9, an electro-mechanical assembly 66 is illustrated with the terminal 60*x* connected to a first contact and the terminal 60*y* connected to a second contact for making and breaking a circuit between a source of electricity and a consumer of electricity or load. The grooves 52 and the protrusions 53 are illustrated as is the engaging slot 54.

To use the present invention, a nut 65, preferably having a lock washer, is placed in the nut retaining cavity 14 with the lock washer toward the top surface 12. The terminal nut retainer 10 is inserted into the grooves 52 and the engaging slot 54 until the locking projections 34 snap into a locked position. The circuit breaker 50 is then ready for an electrical connector 67 to be attached to the terminal 60, without having to take the circuit breaker apart. The terminal 60 can be either the electrical source terminal or the electrical load terminal.

An electrical connector 67 is placed adjacent the terminal 60, and a screw 61 or similar device is inserted through both the terminal 60 and the electrical connector 67. The screw 61 is then inserted into the nut 65 previously retained in the nut retaining cavity 14 and turned to tightly engage the electrical connector 67 against the terminal 60. The terminal nut retainer 10 holds the nut 65 conveniently and securely in place, while providing a dielectric enclosure for the screw 61 and nut 65.

The nut 65 retaining cavity 14 is shaped to matingly receive a nut having a like shape. If the nut 65 has a hexagonal shape, then the nut retaining cavity 14 preferably has a hexagonal shape. The nut retaining cavity 14 is sized to receive the nut 65 in a reasonably snug engagement so that a screw 61 can be tightened in the nut 65 while the nut is held in a fixed position by the walls 20 and the floor 21 of the nut retaining cavity 14. The ridge 18 provides a snug fit, without requiring close tolerances between the walls 20 and the nut.

The projections 30 and the protrusions 53 are meshed with the grooves 52 and the slots 32, respectively, somewhat like the dovetailing of a tenon with a mortise. The interlocking of the locking projections 34 with the engaging slot 54 prevents the terminal nut retainer 10 from sliding out of its fixed position. The meshing of the projections 30 and the protrusions 53 with the slots 52 and the slots 32, respectively, allows the terminal nut retainer 10 to withstand a significant amount of force from a direction transverse to the sliding engagement. This arrangement allows the terminal nut retainer 10 to withstand a significant amount of downward force as a screw 61 is pushed down into the retained nut 65 and turned.

In summary, the present invention provides a circuit breaker 50 having a terminal nut 65 retainer 10 for securely holding a nut in a fixed position adjacent and below the circuit breaker terminal 60. The circuit breaker is placed in a circuit by securing a source electrical connector to the source terminal 60 and/or a load electrical connector to the load terminal 60. A screw 61 is used to engage the nut 65 and fasten the electrical connector 67 to its respective terminal 60. The walls 20 of the nut 65 retaining cavity 14 prevent the nut from turning while the screw 61 is tightened. The projections 30 mesh with the grooves 52 to place the nut 65 in a proper position and to withstand a transverse force that the terminal nut retainer 10 encounters when the screw 61 is pushed into the nut 65 as it is turned. The bottom enclosure 40 insulates the portion of the screw 61 that protrudes through the nut 65 to prevent an arc to a grounded surface.

The foregoing description is directed to a particular embodiment of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A circuit breaker for interrupting power in a circuit path between a source and a load, comprising:

an electro-mechanical assembly including first and second contacts cooperatively arranged in the circuit path for providing current from the source to the load, wherein at least one of the contacts is moveable for interrupting the power provided to the load;

a terminal connected to the first contact;

a casing for enclosing the electro-mechanical assembly;

a terminal nut retainer engaged with the casing proximate to the terminal the terminal nut retainer having a body and a cavity in the body for holding a nut and wherein the body has first opposing sides, the first opposing sides having a tenon and a mortise adjacent the tenon for sliding engagement with the casing and a projection for locking engagement with the casing.

2. The circuit breaker of claim 1, wherein the body has a first projection on one of said first opposing sides.

3. The circuit breaker of claim 2, wherein the casing has a first slot for receiving the first projection.

4. The circuit breaker of claim 1, wherein the body has a top and a bottom, and the cavity is open at the top and closed at the bottom.

5. The circuit breaker of claim 1, wherein the terminal nut retainer is a dielectric.

6. The circuit breaker of claim 3, wherein the body has a panel between the first opposing sides.

7. The circuit breaker of claim 6, wherein the body has a second projection on one of said first opposing sides opposite the first projection.

8. The circuit breaker of claim 7, wherein the casing has a second slot for receiving the second projection.

9. The circuit breaker of claim 1, wherein the terminal nut retainer is a molded dielectric, comprising a body having a box shape having a top, a bottom, and wherein the cavity in the body for receiving the nut is defined by walls and open to the top.

10. An article of manufacture for holding a nut for engagement with a screw, comprising a body having a cavity defined by walls for receiving the nut, and a tenon, and a mortise adjacent the tenon for slideably engaging the body with a casing, and a projection for locking the body in the casing.

11. The article of manufacture of claim 10, wherein the body is shaped like a box having a top, a bottom, and first opposing sides, the first opposing sides each having the projection.

12. The article of manufacture of claim 11, wherein the tenon and the mortise are located on one of the first opposing sides.

13. The article of manufacture of claim 12, further having a screw-end opening adjacent with and concentric with the cavity for receiving an end of a screw engaged with the nut.

14. The article of manufacture of claim 13, wherein the cavity is open towards the top, the screw-end opening is between the cavity and the bottom and open towards the cavity and closed towards the bottom.

15. A method for holding a nut close to a terminal, comprising: placing the terminal in a casing having opposing grooves and opposing slots below the terminal; molding a terminal nut retainer comprising a body having a cavity for holding the nut, and opposing sides, wherein the sides have projections for sliding engagement with the grooves and locking projections for locking engagement with the slots;

placing the nut in the cavity; and inserting the terminal nut retainer into the casing, wherein the projections slideably engage the grooves and the locking projections lock into the slots.

16. The method of claim 15, wherein the body has a first tenon and a first mortise adjacent the first tenon, and the casing has a second mortise and a second tenon for sliding engagement with the first tenon and the first mortise, respectively.

* * * * *